US006297585B1

(12) United States Patent
Tashiro et al.

(10) Patent No.: US 6,297,585 B1
(45) Date of Patent: Oct. 2, 2001

(54) FLUORESCENT LAMP WITH THERMAL PROTECTION ELEMENT MANUFACTURING METHOD FOR THE FLUORESCENT LAMP AND A LIGHTING APPARATUS USING THE SAME

(75) Inventors: Yoji Tashiro; Kenji Itaya, both of Takatsuki (JP)

(73) Assignee: Matushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/346,756

(22) Filed: Jul. 1, 1999

(30) Foreign Application Priority Data

Jul. 10, 1998 (JP) ..... 10-195397

(51) Int. Cl.[7] ..... H01J 5/48; H01J 5/50

(52) U.S. Cl. ..... 313/318.08; 313/318.01; 313/317; 362/21; 362/294

(58) Field of Search ..... 313/317, 318.01–318.12, 313/46, 44; 362/21, 221, 222, 294; 315/56, 58, 59, 71

(56) References Cited

U.S. PATENT DOCUMENTS 4,363,083 * 12/1982 Tanaka et al. ..... 362/294
4,450,512 * 5/1984 Kristofek ..... 362/294
5,161,884 * 11/1992 Siminovitch ..... 362/294

FOREIGN PATENT DOCUMENTS 869541 10/1998 (EP) .
02192650 7/1990 (JP) .
04019901 1/1992 (JP) .
461740 2/1992 (JP) .
536385 2/1993 (JP) .
10188906 7/1998 (JP) .
10321192 12/1998 (JP) .
11111231-A * 4/1999 (JP) .
9212526 7/1992 (WO) .

* cited by examiner

*Primary Examiner*—Nimeshkumard D. Patel
*Assistant Examiner*—Mariceli Santiago
(74) *Attorney, Agent, or Firm*—Price and Gess

(57) ABSTRACT

A fluorescent lamp includes an end cap 4 and a fluorescent tube 1 that has electrode seals 22 and 23 at its ends. The end cap 4 is made of synthetic resin and is attached to the fluorescent tube 1 by silicon resin 31. The end cap 4 includes round cavities 26 and 27 for holding the electrode seals 22 and 23 and thermal protection element holders 20 and 21 for holding thermal protection elements 16 and 17 adjacent to the electrode seals 22 and 23. Pillars 28 are provided between the thermal protection element holders 20 and 21 and the round cavities 26 and 27 to support the thermal protection elements 16 and 17. Through holes 29 are provided between the round cavities 26 and 27 and pillars 28.

19 Claims, 9 Drawing Sheets

FLUORESCENT LAMP WITH THERMAL PROTECTION ELEMENT MANUFACTURING METHOD FOR THE FLUORESCENT LAMP AND A LIGHTING APPARATUS USING THE SAME

BACKGROUND OF THE INVENTION

1. Field of the Invention

The present invention relates to a fluorescent lamp that includes an end cap formed of synthetic resin, a manufacturing method for such a fluorescent lamp, and to a lighting apparatus that uses the same.

2. Prior Art

A known problem for fluorescent lamps is that the temperature of the electrode seals at the ends of a fluorescent tube rises sharply as the fluorescent tube approaches the end of its operating life.

The improvements in efficiency of fluorescent lamps and the concurrent reductions in their size and weight have led to an increase in the use of fluorescent lamp apparatuses. Such apparatuses use high-frequency inverter lighting circuits to light the fluorescent tubes. However, a particular problem has been observed when a fluorescent tube used in such an apparatus reaches the end of its operating life. When the emissive material that is originally present within the electrode filament has been dispersed, the cathode drop voltage increases and so prevents the fluorescent lamp from illuminating. However, the high-frequency inverter lighting circuit will continue to supply a preheating voltage to the electrode filament, so that electrode filament will remain in its preheated state. As a result, arc discharge occurs between the lead wires inside the electrode which increases the temperature of the electrode seal.

It is believed that the above problem is caused by the high current-feed capacity of the high-frequency inverter lighting circuit.

The above problem is especially prevalent in compact single-ended fluorescent lamps where the fluorescent tubes have a relative small diameter and two electrode seals are enclosed within a single end cap formed of synthetic resin. In conventional compact single-ended fluorescent lamps, the electrode seals that act as the problematic heat sources are located alongside one another, so that the aforementioned rise in temperature is especially marked. Heat dissipation is also poor, since the synthetic resin end cap encloses the two electrode seals. These factors result in an excessive rise in temperature which in extreme cases can lead to deformity in the end cap.

Japanese Laid-Open Patent Application H02-192650 discloses a technology that can prevent such rises in temperature at the ends of a fluorescent lamp. A thermal fuse is provided near the end of the fluorescent tube, so that when the temperature at the end of the fluorescent tube rises at the end of the operating life of the fluorescent tube, the thermal fuse will melt, thereby breaking the lighting circuit.

This technology has the thermal fuse located on the outside of the fluorescent lamp. This results in the thermal fuse being visible, which spoils the external appearance of such lamps. When a fluorescent lamp is formed by connecting four or more fluorescent tubes to a single end cap, it would be possible to keep the thermal fuses hidden from view by placing them in a space on the back side of the end cap. However, no such space is conventionally available on an end cap, so that it has only been possible to provide the thermal fuses on the outside of the cap where they will be clearly visible.

SUMMARY OF THE INVENTION

In view of the stated problems, it is a first object of the present invention to provide a fluorescent lamp that has a rationalized construction whereby the positioning of thermal protection elements on the outside of the fluorescent lamp can be avoided.

It is a second object of the present invention to provide a fluorescent lamp with a novel construction whereby thermal protection elements are enclosed within the end cap.

It is a third object of the present invention to provide a fluorescent lamp with a novel construction whereby thermal protection elements are kept from being visible with an end cap that has the same outer dimensions as conventional models;

It is a fourth object of the present invention to provide a fluorescent lamp with a construction where a thermal protection element is thermally coupled to each end of a fluorescent tube.

It is a fifth object of the present invention to provide a single-ended fluorescent lamp that includes thermal protection elements and has a rationalized construction;

It is a sixth object of the present invention to provide a manufacturing method for a fluorescent lamp with a rationalized construction whereby the positioning of thermal protection elements on the outside of the fluorescent lamp can be avoided.

It is a seventh object of the present invention to provide a manufacturing method that can attach thermal protection elements to a fluorescent lamp that has an end cap made of synthetic resin.

It is an eighth object of the present invention to a lighting apparatus that has a plurality of fluorescent lamps with thermal protection elements connected in series and is suited to high-frequency illumination The above first object can be realized by a fluorescent lamp, including: a fluorescent tube that has an electrode sealed at each end by an electrode seal; a thermal protection element that is sensitive to ambient temperature and is capable of disconnecting an internal circuit; an end cap that has a first cavity and a second cavity formed in one surface and an electrode terminal that protrudes from another surface, the first cavity being adjacent to the second cavity, where one end of the fluorescent tube is inserted into the first cavity so that the electrode seal at the inserted end is enclosed by the end cap, and the thermal protection element is embedded into the second cavity so as to be thermally coupled to the electrode seal at the inserted end of the fluorescent tube, with one terminal of the thermal protection element being connected to a lead wire of the fluorescent tube and another terminal being connected to an electrode terminal.

With the stated construction, a thermal protection element is located close to the electrode seal to which it is thermally coupled. The thermal protection element is therefore sensitive to the rise in temperature that occurs in the electrode seal at the end of the operating life of the fluorescent lamp, and so quickly breaks the circuit.

Here, if through-holes are provided in the side wall between the first cavity and the second cavity, an improved thermal coupling can be achieved between the electrode seals of the fluorescent tube and the thermal protection elements. As an additional benefit, the final assembly process that fills the remaining spaces in the first and second cavities with synthetic material can be achieved by injecting the material at only one position, which simplifies the assembly of the fluorescent lamp.

Since the remaining spaces in the first and second cavities are filled with synthetic material, the thermal protection elements and the electrode seals are firmly attached to the end cap. The openings in the second cavities are also covered with lids, giving the fluorescent lamp a pleasing external appearance.

The above first object can be realized by a fluorescent lamp, including: a fluorescent tube that is formed with both tube ends being adjacent and has an electrode seal which seals a thermonic cathode-type electrode at each tube end; a pair of thermal protection elements that are sensitive to ambient temperature and are capable of disconnecting an internal circuit; a single end cap that has a pair of first cavities and a pair of second cavities in one main surface and electrode terminals that protrude from another main surface, each first cavity being adjacent to a different one of the second cavities, where each end of the fluorescent tube is inserted into each first cavity so that the end cap encloses the electrode seals, and the thermal protection elements are embedded into the second cavities so as to be thermally coupled to the electrode seals, and each thermal protection element has one terminal connected to a lead wire of the fluorescent tube and another terminal connected to one of the electrode terminals.

Here, in the above fluorescent lamp, each of the pair. of the second cavities may be formed in one of a pair of areas of one main surface of the single end cap, each of the pair of areas being shaped in an approximately triangular prism and surrounded by a side edge of the single end cap and the two first cavities.

If the second cavities are provided at the stated position, the thermal protection elements can be provided inside the end cap without needing to change the form of the end cap from the form used by conventional models.

The above sixth and seventh objects can be realized by a manufacturing method for a fluorescent lamp including a fluorescent lamp, a thermal protection element, and an end cap, the fluorescent tube having electrodes that are sealed inside the fluorescent tube by electrode seals provided at each end of the fluorescent tube, the thermal protection element being sensitive to ambient temperature and being capable of disconnecting an internal circuit, and the end cap having a first cavity and a second cavity formed in one surface and an electrode terminal that protrudes from another surface, the first cavity being adjacent to and connected to the second cavity by at least one opening provided in side walls of the cavities, the manufacturing method including: a first step for inserting one end of the fluorescent tube into the first cavity and the thermal protection element into the second cavity; and a second step for filling remaining spaces in the first cavity and the second cavity with resinous material to attach the fluorescent tube and the thermal protection element to the end cap.

With the stated method, the injected synthetic material will flow through the connection into both the first and second cavities, thereby simultaneously attaching both the thermal protection element and the fluorescent tube to the end cap. The injection of synthetic resin only needs to be performed at one position.

These objects can also be realized by a manufacturing method for a fluorescent lamp including a fluorescent lamp, a thermal protection element, and an end cap, the fluorescent tube having electrodes that are sealed inside the fluorescent tube by electrode seals provided at each end of the fluorescent tube, the thermal protection element being sensitive to ambient temperature and being capable of disconnecting an internal circuit, and the end cap having a first cavity and a second cavity formed in one surface and an electrode terminal that protrudes from another surface, the first cavity being adjacent to and connected to the second cavity by at least one opening provided in side walls of the cavities, the manufacturing method including: a first step for inserting the thermal protection element into the second cavity; a second step for pouring resinous material into the first cavity; a third step for inserting one end of the fluorescent tube into the first cavity so that the resinous material is pushed into the second cavity via the at least one opening between the first cavity and the second cavity.

With the stated method, the injected synthetic material will be pushed through the connection into the second cavity when the fluorescent tube is inserted into the first cavity, thereby simultaneously attaching both the thermal protection element and the fluorescent tube to the end cap. The application of synthetic resin only needs to be performed once.

The above eighth object can be realized by a lighting apparatus, including: an illuminating unit including a plurality of fluorescent lamps as disclosed earlier that are connected in series; and a high-frequency inverter lighting circuit for lighting each of the fluorescent lamps.

The above lighting apparatus includes a plurality of fluorescent lamps connected in series and a high-frequency inverter lighting circuit. A separate external lead wire is connected to a thermal protection element enclosed near an electrode seal at each end of each fluorescent lamp. As a result, when there is an extreme rise in the temperature inside the end cap, it is guaranteed that the thermal protection element will melt and cut off the circuit.

BRIEF DESCRIPTION OF THE DRAWINGS

These and other objects, advantages and features of the invention will become apparent from the following description thereof taken in conjunction with the accompanying drawings which illustrate a specific embodiment of the invention. In the drawings.

DESCRIPTION OF THE PREFERRED EMBODIMENTS

Figure 1:
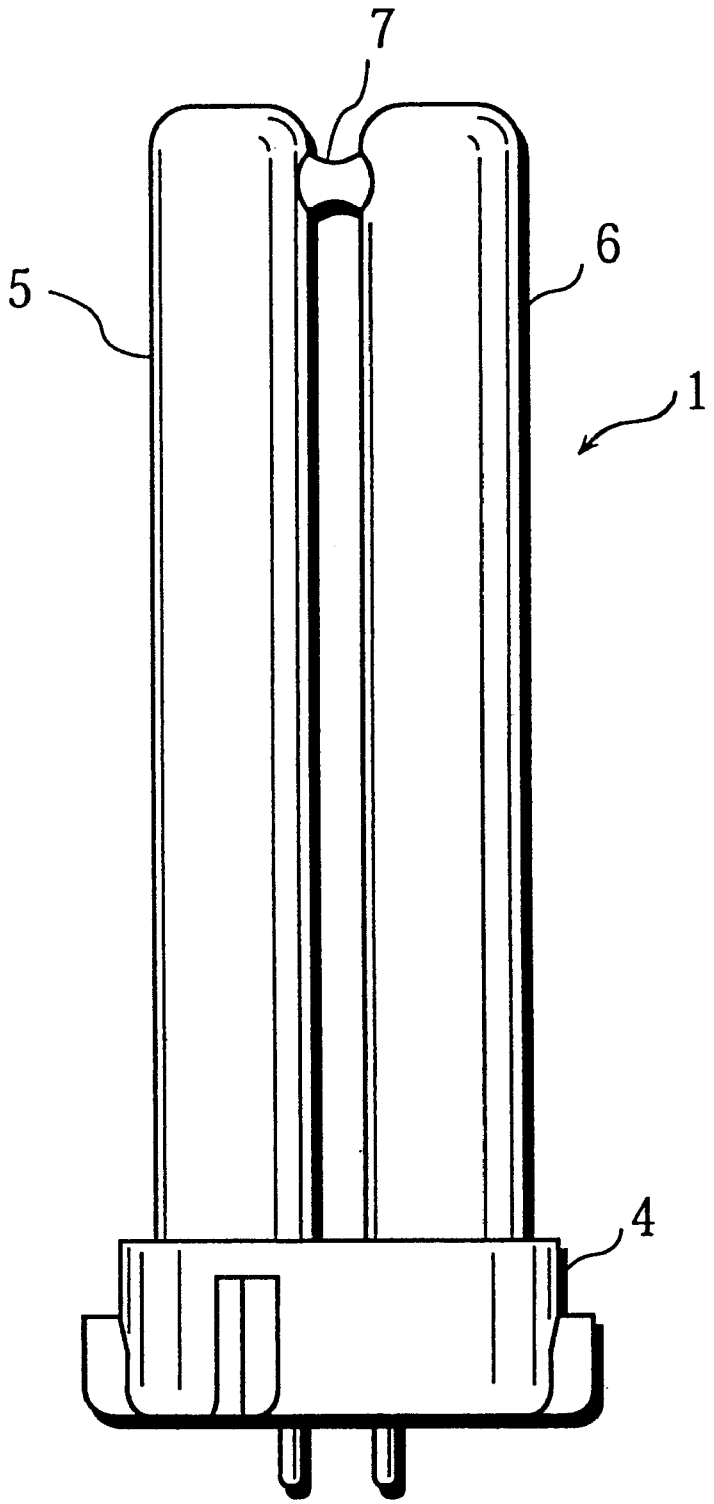
FIG. 1 is a front elevation of a fluorescent lamp that is an embodiment of the present invention.
Figure 2:
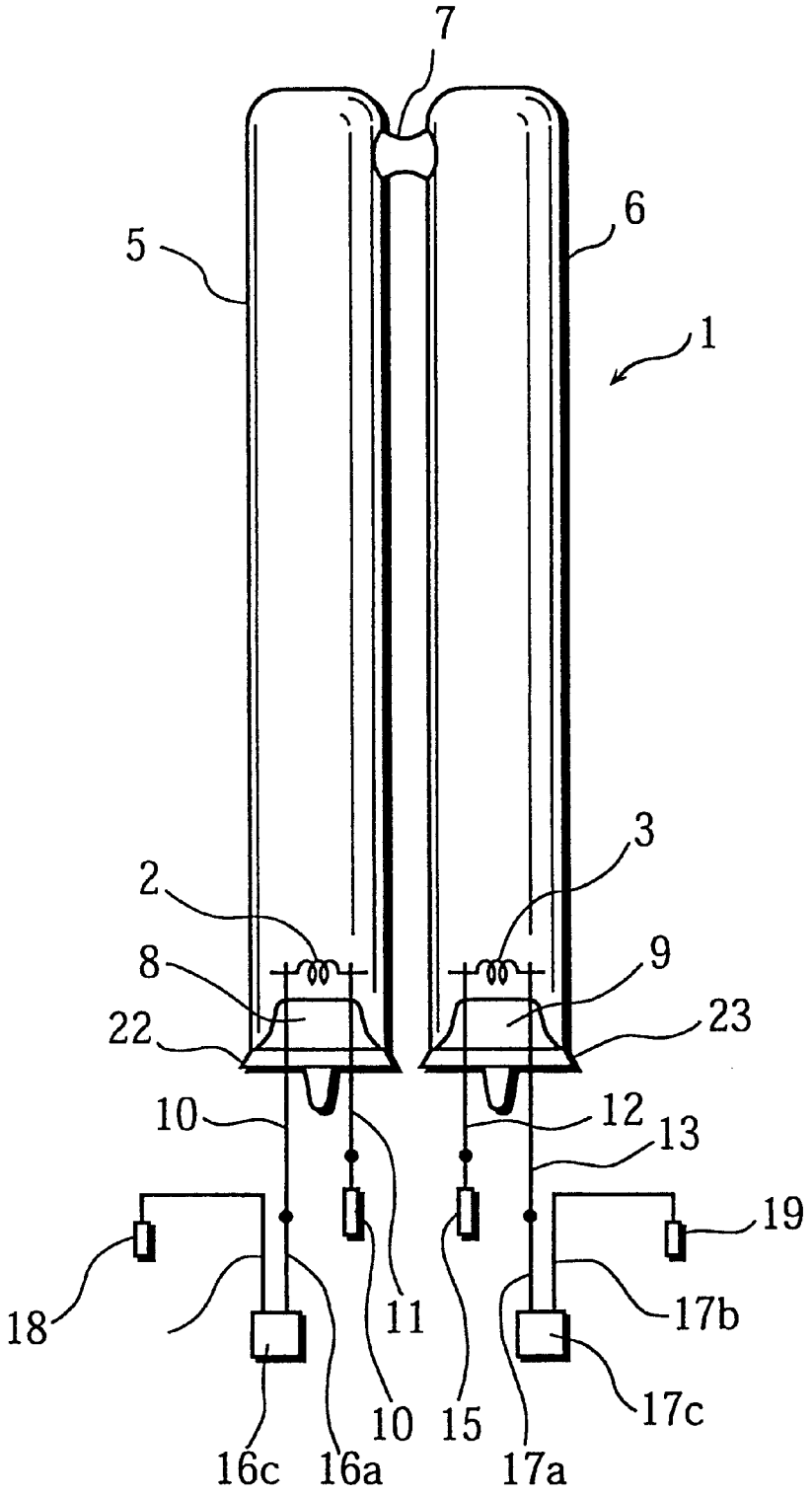
FIG. 2 shows how the lead wires are connected in the fluorescent lamp.
Figure 3:
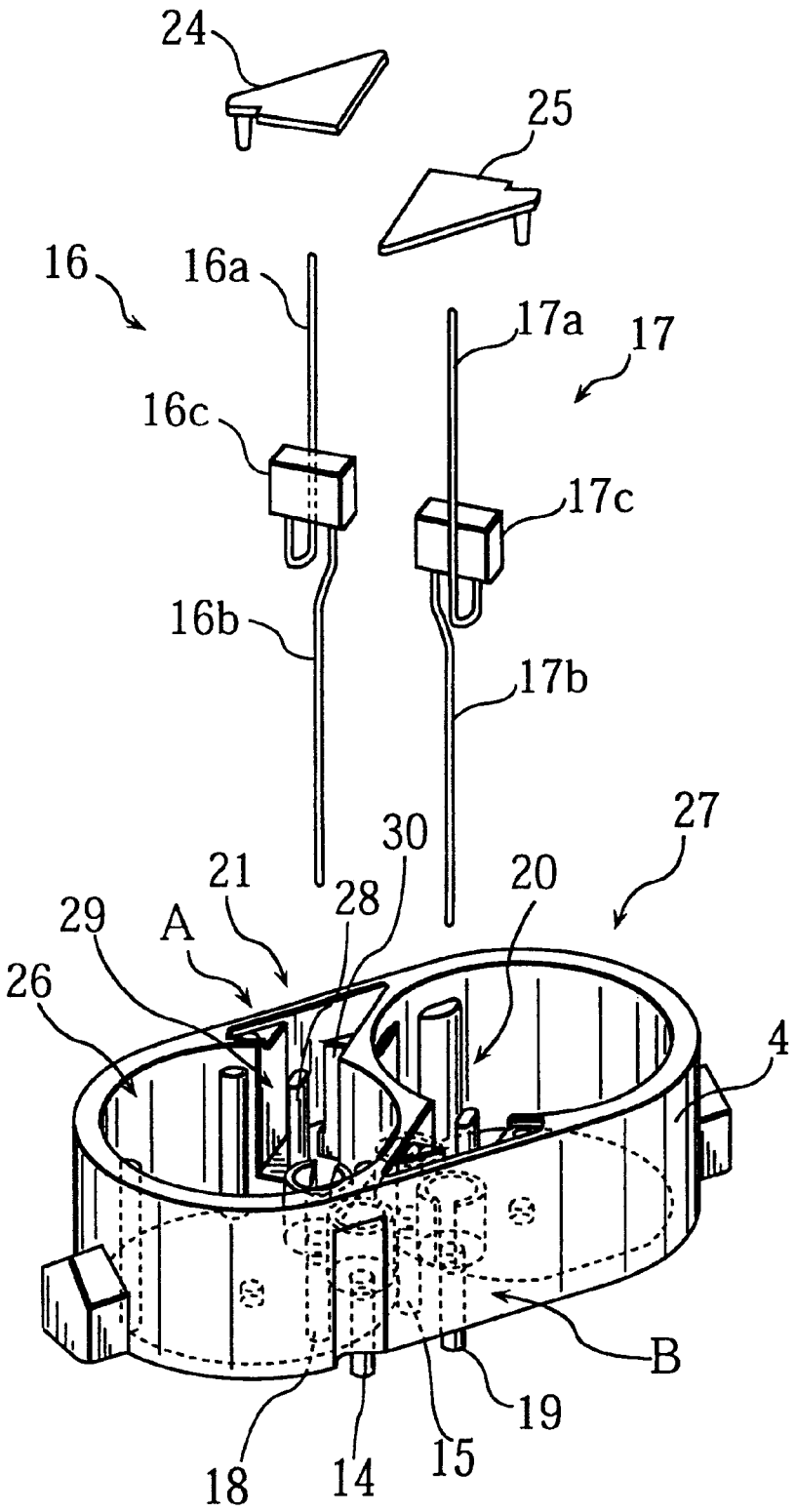
FIG. 3 shows the construction of the end cap and its periphery before the thermal protection elements are attached.

A single-ended fluorescent lamp that is an embodiment of the present invention is shown in FIGS. 1~3. As shown in these drawings, the single-ended fluorescent lamp includes a fluorescent tube 1 and an end cap 4. The fluorescent tube 1 has mercury and an inert gas as a buffer gas sealed inside it, and has electrodes 2, 3 respectively formed at its ends. The end cap 4 supports this fluorescent tube 1.

The fluorescent tube 1 is composed of two straight tube bulbs 5 and 6 that are made of glass and are disposed in parallel. A bridge connection 7 is formed in facing tube walls at one end of the straight tube bulbs 5 and 6 to connect the tubes. Electrode seals 22 and 23, which seal the stems 8 and 9 that in turn respectively support the electrodes 2 and 3, are formed at the other ends of the straight tube bulbs 5 and 6.

The lead wires 10, 11, 12, and 13 pass through the stems 8 and 9 in a sealed state and are connected to the electrodes 2 and 3.

The discharge path is electrode 2→straight tube bulb 5→bridge connection 7→straight tube bulb 6→electrode 3, for example, so that discharge is performed across most of the length of the fluorescent tube 1.

Figure 4:
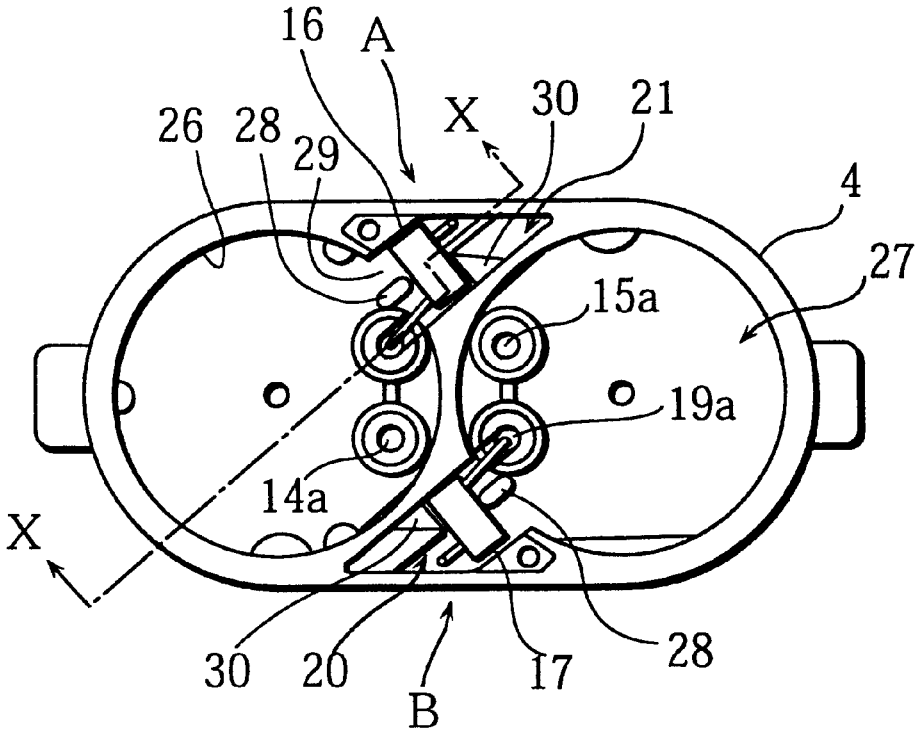
FIG. 4 is an overhead view of the end cap.

The end cap 4 is an integral component formed of a synthetic resin such as polyethylene terephthalate (PET) or polybutylene terephthalate (PBT). As shown in FIGS. 3 and 4, two round cavities 26 and 27 and two thermal protection element holders 20 and 21 are formed in one of main surfaces of the end cap 4, while four terminals 14, 15, 18 and 19 protrude from the other main surface.

Figure 5:
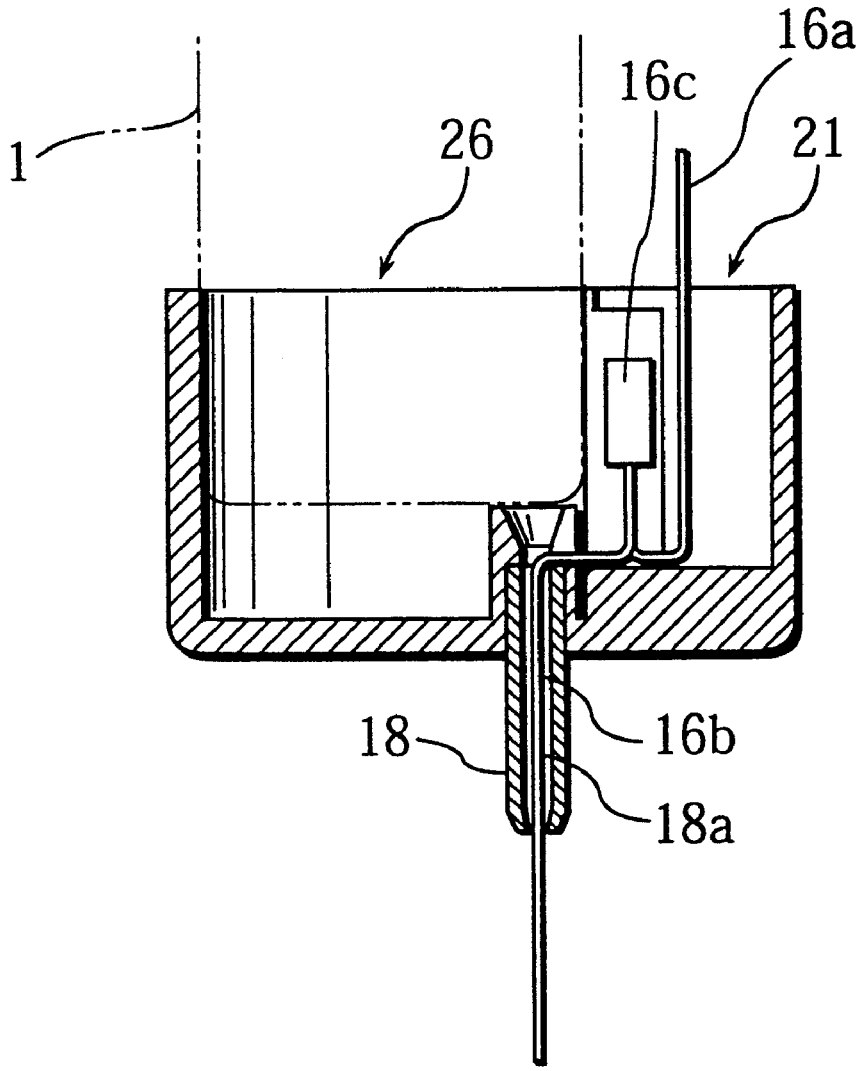
FIG. 5 is a cross-section of the end cap taken along the line marked X—X in FIG. 4.

The round cavities 26 and 27 have a suitable diameter and depth for inserting the pair of electrode seals 22 and 23 of the fluorescent tube 1, so that the side walls of the round cavities 26 and 27 enclose the bottom parts of the electrode seals 22 and 23 when these are inserted. As shown in FIGS. 4 and 5, the bases of the round cavities 26 and 27 have openings 14*a*, 15*a*, 18*a*, and 19*a* that are connected to the channels formed inside the terminals 14, 15, 18, and 19.

The thermal protection element holders 20 and 21 have suitable dimensions to enclose the thermal protection elements 16 and 17. As can be seen from FIGS. 3 and 4, these holders 20 and 21 are positioned inside the pillars A and B where the thickness of the resin between the inner walls of the round cavities 26 and 27 and side faces of the end cap 4 is greatest. These pillars A and B are triangular pillars that are formed between the inner walls of the round cavities 26 and 27 and the side face of the end cap 4. When seen from above, the holders 20 and 21 are triangular cavities that resemble the shapes of the pillars A and B. Each of these triangular cavities has a side wall on the inside of the end cap 4 that is partially open to a different one of the round cavities 26 and 27. These partial openings are called the through-holes 29. In this way, the holder 20 is linked to the round cavity 27 and the holder 21 is linked to the round cavity 26. The holders 20 and 21 are linked to the round cavities 26 and 27 to improve thermal coupling between the electrode seals 22 and 23 of the fluorescent tube 1 and the thermal protection elements 16 and 17. This has the further benefit of simplifying the injection of silicon resin during manufacture since resin that is injected into the round cavities 26 and 27 will also flow into the holders 20 and 21.

A thin pillar 28 extends from the base of the end cap 4 inside the through-hole 29 between the holder 20 and the round cavity 27. When the thermal protection element 17 is inserted into the holder 20, this pillar 28 holds the thermal protection element 17 in the correct position. A wall protrusion 30 is formed at an opposite position to the pillar 28 inside the holder 20. This wall protrusion 30 supports the thermal protection element 17 from behind and together with the pillar 28 ensures that the thermal protection element 17 is held upright. As a result, there is no variation in the respective distances between the electrode seals 22 and 23 of the fluorescent tube 1 and the thermal protection elements 16 and 17.

A pillar and wall protrusion are similarly formed for the round cavity 21, although these will not be described. Note that the holders 20 and 21, the pillars 28, and the wall protrusions 30 are all integrally formed as parts of the end cap 4 when the end cap 4 is manufactured.

Thermal fuses that melt at a high temperature are preferably used as the thermal protection elements 16 and 17. These thermal protection elements 16 and 17 comprise the elements 16*c* and 17*c* and the lead wires 16*a*, 16*b*, 17*a*, and 17*b* that are connected to the elements 16*c* and 17*c* (see FIGS. 2, 3, and 5). The elements 16*c* and 17*c* are held between the pillars 28 and the wall protrusions 30 in the holders 20 and 21, with the lead wires 16*b* and 17*b* passing through the through-holes 29 and then through the channels 18*a* and 19*a*, which are formed in the bases of the round cavities 26 and 27, to the terminals 18 and 19. The other lead wires 16*a* and 17*a* are connected to the lead wires 10

Figure 6:
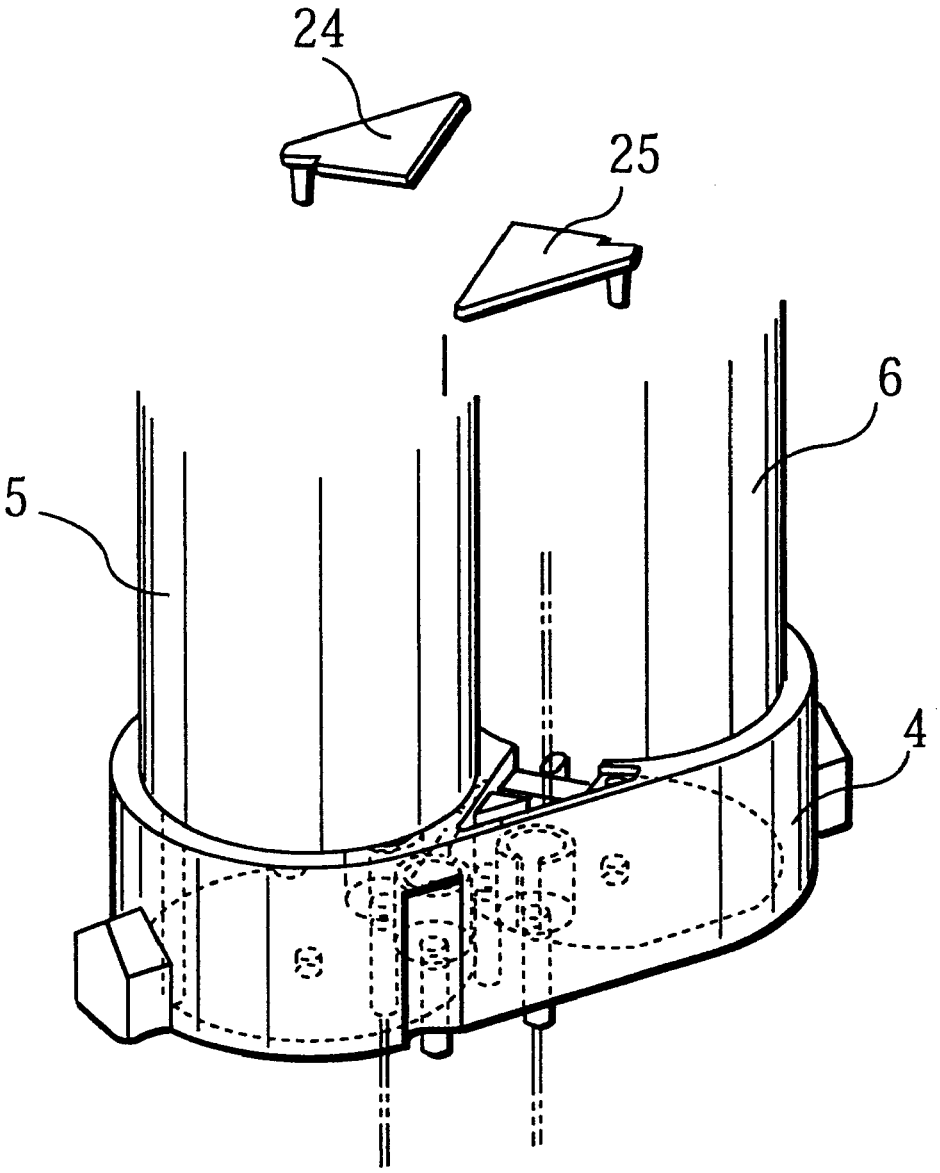
FIG. 6 shows the end cap and its periphery during assembly.
Figure 7:
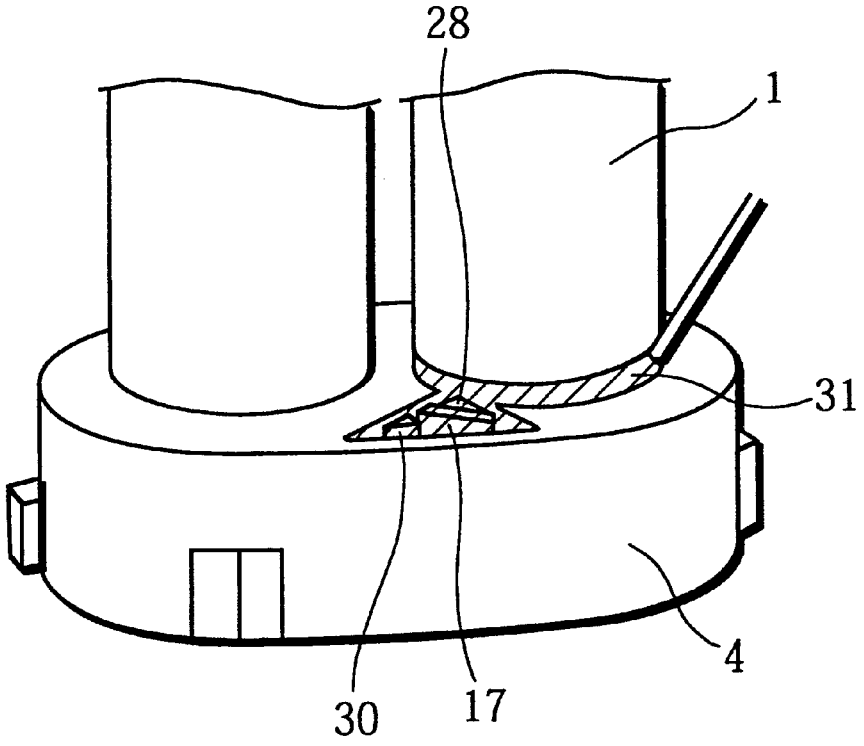
FIG. 7 shows how the silicon resin may be injected.

As shown in FIG. 6, both ends of the fluorescent tube 1 are inserted into the round cavities 26 and 27, and the thermal protection elements 16 and 17 are placed into the holders 20 and 21. The lead wires 16*a*, 16*b*, 17*a*, and 17*b* are attached as shown in FIG. 2. After this, the remaining spaces in the round cavities 26 and 27 and the holders 20 and 21 are filled with silicon resin, as shown in FIG. 7, and then the openings at the top of the holders 20 and 21 are covered up using lids 24 and 25 that have the same shape. These lids 24 and 25 are formed of the same synthetic resin as the end cap 4.

With the above construction, the thermal protection elements 16 and 17 are located close to the electrode seals 22 and 23 that are enclosed by the round cavities 26, 27. This achieves favorable thermal coupling, so that the thermal protection elements 16 and 17 are quickly exposed to a rise in temperature in the electrode seals 22 and 23 at the end of the operating life of the fluorescent tube. The thermal protection elements 16 and 17 will therefore melt and so prevent the further preheating of the electrodes 2 and 3.

The fluorescent lamp of the present embodiment is a single-ended fluorescent lamp (see FIG. 1) for 100V 36 W standard and comprises an end cap 4 formed of PBT resin and a fluorescent tube 1 having straight tube bulbs 5, 6 with an external diameter of 20 mm and the total length, including the bridged connection, of 410 mm. Thermal protection elements 16 and 17 have a melting point of around 160~165° C. These thermal protection elements 16 and 17 are disposed at a distance of 1.0~1.2 mm from the electrode seals 22 and 23.

The fluorescent lamp of the present embodiment soon reacts to a rise in temperature in the electrode seals 22 and 23 that occurs at the end of operating life, so that the circuit is soon broken. The thermal protection elements 16 and 17 are easily attached inside the end cap 4 and do not increase its size. The lids 24 and 25 conceal the thermal protection elements 16 and 17, giving the further benefit of a more appealing appearance than that described in the prior art.

It should be obvious that the present invention is not limited to the thermal protection elements 16 and 17 being positioned at the aforementioned distance from the electrode seals 22 and 23. This distance should obviously be determined in accordance with the dimensions of the fluorescent lamp and its power rating. It was found through experimentation that a favorable thermal coupling can be achieved with distances up to 5 mm. Also, if a material with good thermal transfer characteristics is used to fill the spaces in the round cavities 26 and 27 and the holders 20 and 21, the thermal protection elements 16 and 17 can be disposed at a greater distance from the electrode seals 22 and 23.

The following describes an example method for manufacturing the fluorescent lamp described above.

First, thermal protection elements 16 and 17 that each have two lead wires are inserted into the holders 20 and 21 in the end cap 4, and the lead wires 16*b* and 17*b* of the thermal protection elements 16 and 17 are connected to the terminals 18 and 19 of the end cap 4.

Next, the lead wires 11 and 12 of the fluorescent tube 1 are threaded through the terminals 14 and 15 of the end cap 4 and the electrode seals 22 and 23 of the fluorescent tube 1 are inserted into the round cavities 26 and 27. The lead wires 10 and 13 of the fluorescent tube 1 are then connected to the lead wires 16*a* and 17*a* of the thermal protection element 16 and 17 by welding or a similar technique. Next, as shown in FIG. 5, silicon resin 31 is injected into the gaps between the end cap 4 and the fluorescent tube 1 and so flows through the through-holes 29 into the holders 20 and 21. In FIG. 7, the injected silicon resin 31 is shown using oblique shading. The construction is then heated in an electric oven to harden the silicon resin 31, thereby securely attaching the fluorescent tube 1 and the thermal protection elements 16 and 17 to the end cap 4. Finally, the holders 20 and 21 are covered by the lids 24 and 25.

As a different method, the fluorescent tube 1 may be inserted into the round cavities 26 and 27 of the end cap 4 after the silicon resin 31 has be injected into the round cavities 26 and 27. By doing so, the silicon resin 31 will be pressed through the through-holes 29 into the holders 20 and 21 by the insertion of the fluorescent tube 1. This silicon resin 31 attaches the fluorescent tube 1 and the thermal protection elements 16 and 17 to the end cap 4, as described above.

These manufacturing methods for the present fluorescent lamp attach the fluorescent tube 1 and the thermal protection elements 16 and 17 to the end cap 4 by performing only one operation for injecting the silicon resin 31. Accordingly, this attachment can be achieved without increasing the number of processing steps.

The following describes a lighting apparatus that uses the present fluorescent lamp.

Figure 8:
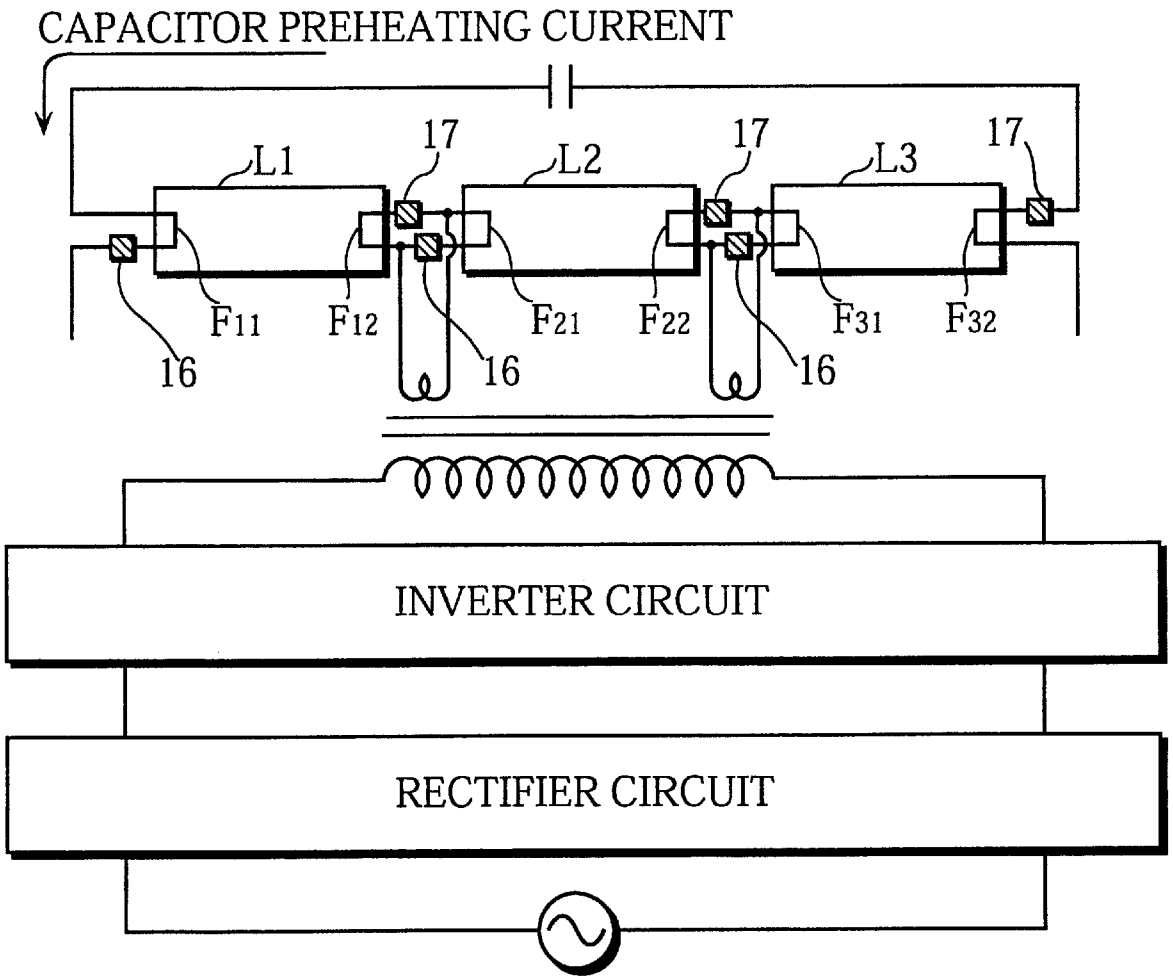
FIG. 8 is a circuit diagram for a lighting apparatus that uses the fluorescent lamp of the present invention.

FIG. 8 shows a construction where three of the fluorescent lamps (numbered L1, L2, and L3) are linked in series and are connected to a high-frequency inverter lighting circuit. As can be seen from FIG. 8, each filament F11, F12, F21, F22, F31, and F32 of each fluorescent lamp is connected in series to a thermal protection element 16 or 17, so that the filaments F11~F32 are also connected to a thermal protection element 16 or 17 in the circuit where the capacitor preheating current flows. At the end of the life of a fluorescent lamp, the preheating current will cause a rise in the temperature of the electrode seal of the lamp, though this will result in the thermal protection element melting and thereby cutting off the flow of the preheating current.

Figure 9:
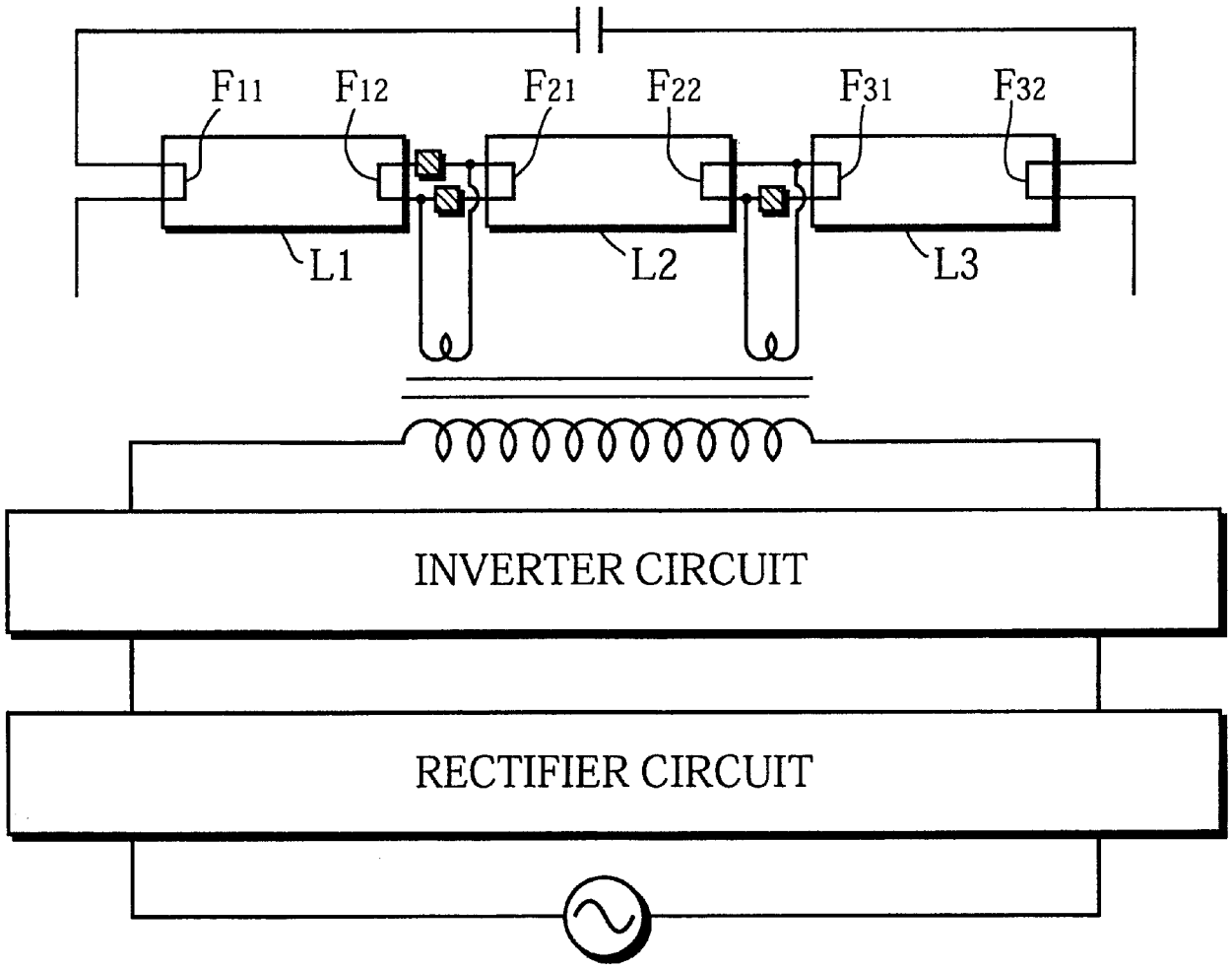
FIG. 9 is a circuit diagram showing a lighting apparatus used as a comparative example.

A comparative example is shown in FIG. 9. This example shows a lighting apparatus that uses fluorescent lamps but has only one filament of each fluorescent lamp connected to a thermal protection element. As shown in FIG. 9, the thermal protection elements are not positioned on the circuit where the preheating current flows, so that such thermal protection elements cannot effectively prevent the electrode seals from overheating due to the continued application of the capacitor preheating current.

The inventors of this invention performed experiments to investigate the lighting apparatuses of FIGS. 8 and 9. These experiments showed that when a fluorescent lamp in the lighting apparatus of FIG. 8 approached the end of its life, the increase in temperature in the end cap 4 melted the thermal protection elements 16 and 17 and so completely cut off the capacitor preheating current, thereby preventing the end cap 4 from damage. In the lighting apparatus of FIG. 9, however, the capacitor preheating current was not cut off at the end of the life of one of the fluorescent lamps, which led to an end cap being damaged by the excessive heat.

Although the present invention has been fully described by way of examples with reference to accompanying drawings, it is to be noted that various changes and modifications will be apparent to those skilled in the art. Therefore, unless such changes and modifications depart from the scope of the present invention, they should be construed as being included therein.

What is claimed is:

1. A fluorescent lamp, comprising:

a fluorescent tube that has an electrode sealed at each end by an electrode seal;

a thermal protection element that is sensitive to ambient temperature and is capable of disconnecting an internal circuit;

an end cap that has a first cavity and a second cavity formed in one surface and an electrode terminal that protrudes from another surface, the first cavity being adjacent to the second cavity, wherein one end of the fluorescent tube is inserted into the first cavity so that the electrode seal at the inserted end is enclosed by the end cap, and the thermal protection element is embedded into the second cavity so as to be thermally coupled to the electrode seal at the inserted end of the fluorescent tube, with one terminal of the thermal protection element being connected to a lead wire of the fluorescent tube and another terminal being connected to an electrode terminal.

2. The fluorescent lamp of claim 1, wherein the first cavity and the second cavity are connected by at least one opening provided in side walls of the cavities.

3. The fluorescent lamp of claim 2, wherein a member for supporting the thermal protection element in an upright position is provided inside the second cavity.

4. The fluorescent lamp of claim 3, wherein remaining spaces in the first cavity and the second cavity are filled with a resinous material and a lid is provided on an opening of the second cavity.

5. The fluorescent lamp of claim 4, wherein the end cap is an integral body that is formed of synthetic resin.

6. The fluorescent lamp of claim 4 further including an illuminating unit supporting a plurality of fluorescent lamps that are connected in series, and a high frequency inverter lighting circuit for lighting each of the fluorescent lamps.

7. A lighting apparatus, comprising:

an illuminating unit including a plurality of fluorescent lamps as disclosed in claim 1 that are connected in series; and a high-frequency inverter lighting circuit for lighting each of the fluorescent lamps.

8. A fluorescent lamp, comprising:

a fluorescent tube that is formed with both tube ends being adjacent and has an electrode seal which seals a thermonic cathode-type electrode at each tube end;

a pair of thermal protection elements that are sensitive to ambient temperature and are capable of disconnecting an internal circuit;

a single end cap that has a pair of first cavities and a pair of second cavities in one main surface and electrode terminals that protrude from another main surface, each first cavity being adjacent to a different one of the second cavities, wherein each end of the fluorescent tube is inserted into each first cavity so that the end cap encloses the electrode seals, and the thermal protection elements are embedded into the second cavities so as to be thermally coupled to the electrode seals, and each thermal protection element has one terminal connected to a lead wire of the fluorescent tube and another terminal connected to one of the electrode terminals.

9. The fluorescent lamp of claim 8, wherein each of the pair of the second cavities are formed in one of a pair of areas of one main surface of the single end cap, each of the pair of areas being shaped in an approximately triangular prism and surrounded by a side edge of the single end cap and the two first cavities.

10. The fluorescent lamp of claim 9, wherein each first cavity is connected to the adjacent second cavity due to part of an inner wall between the first cavity and the second cavity being missing.

11. The fluorescent lamp of claim 10, wherein a member for holding one of the thermal protection elements in a predetermined position is provided inside each second cavity.

12. The fluorescent lamp of claim 11, wherein a member for supporting the thermal protection element in an upright position is provided inside the second cavity.

13. The fluorescent lamp of claim 12, wherein the single end cap is an integral body that is formed of synthetic resin.

14. The fluorescent lamp of claim 13 further including an illuminating unit supporting a plurality of fluorescent lamps that are connected in series; and a high-frequency inverter lighting circuit for lighting each of the fluorescent lamps.

15. The fluorescent lamp of claim 8 further including an illuminating unit supporting a plurality of fluorescent lamps that are connected in series; and a high-frequency inverter lighting circuit for lighting each of the fluorescent lamps.

16. The fluorescent lamp of claim 8, wherein the thermal protection elements are positioned within 5 mm of the electrode seals.

17. A manufacturing method for a fluorescent lamp including a fluorescent lamp, a thermal protection element, and an end cap, the fluorescent tube having electrodes that are sealed inside the fluorescent tube by electrode seals provided at each end of the fluorescent tube, the thermal protection element being sensitive to ambient temperature and being capable of disconnecting an internal circuit, and the end cap having a first cavity and a second cavity formed in one surface and an electrode terminal that protrudes from another surface, the first cavity being adjacent to and connected to the second cavity by at least one opening provided in side walls of the cavities, the manufacturing method comprising:

a first step for inserting one end of the fluorescent tube into the first cavity and the thermal protection element into the second cavity; and a second step for filling remaining spaces in the first cavity and the second cavity with resinous material to attach the fluorescent tube and the thermal protection element to the end cap.

18. The manufacturing method of claim 17, wherein the resinous material is injected into the first cavity and second cavity at one position and flows though the at least one opening between the first cavity and the second cavity to fill all the remaining spaces.

19. A manufacturing method for a fluorescent lamp including a fluorescent lamp, a thermal protection element, and an end cap, the fluorescent tube having electrodes that are sealed inside the fluorescent tube by electrode seals provided at each end of the fluorescent tube, the thermal protection element being sensitive to ambient temperature and being capable of disconnecting an internal circuit, and the end cap having a first cavity and a second cavity formed in one surface and an electrode terminal that protrudes from another surface, the first cavity being adjacent to and connected to the second cavity by at least one opening provided in side walls of the cavities, the manufacturing method comprising:

a first step for inserting the thermal protection element into the second cavity;

a second step for pouring resinous material into the first cavity;

a third step for inserting one end of the fluorescent tube into the first cavity so that the resinous material is pushed into the second cavity via the at least one opening between the first cavity and the second cavity.

* * * * *